United States Patent [19]

English

[11] 4,049,205

[45] Sept. 20, 1977

[54] HORIZONTAL, DETACHABLE, BALL MILL

[75] Inventor: Robert William English, Stratford-on-Avon, England

[73] Assignee: The Mastermix Engineering Company Limited, Hereford, England

[21] Appl. No.: 708,039

[22] Filed: July 23, 1976

[30] Foreign Application Priority Data

July 29, 1975 United Kingdom ..... 31628/75

[51] Int. Cl.[2] ..... B02C 23/36

[52] U.S. Cl. ..... 241/67

[58] Field of Search ..... 241/46.11, 46.15, 46.17, 241/65, 67, 66

[56] References Cited

U.S. PATENT DOCUMENTS

| | | | |
|---|---|---|---|
| 1,141,898 | 6/1915 | Merritt | 241/66 |
| 2,060,408 | 11/1936 | Wood | 241/67 |
| 2,848,171 | 8/1958 | Andrews | 241/DIG. 32 |
| 2,918,223 | 12/1959 | Eppenbach | 241/67 |
| 3,050,263 | 8/1962 | Barkman et al. | 241/46.17 |
| 3,243,128 | 3/1966 | Tight | 241/65 |
| 3,685,749 | 8/1972 | Brown | 241/65 |
| 3,843,064 | 10/1974 | Suzuki | 241/67 |
| 3,957,210 | 5/1976 | Durr | 241/46.11 |

*Primary Examiner*—Granville Y. Custer, Jr.
*Attorney, Agent, or Firm*—Marshall & Yeasting

[57] ABSTRACT

A mill comprises a shaft mounted in a pair of bearings located at one end of the shaft, and a wall having an opening through which the shaft extends. A horizontal-flow container for the charge is removably mounted at one end in cantilever fashion upon one side of said wall and has a screened outlet at its other end. A tubular inlet housing is mounted on the other side of said wall, surrounding a portion of the shaft between said wall and said bearings, and has a seal through which the shaft enters the inlet housing. A feed screw is mounted on said portion of the shaft. Another portion of the shaft, extending within the container, is of greater diameter than said opening and is closely spaced from said wall to provide a narrow gap through which material passes from the inlet housing into the container. The shaft is hollow and has means for circulating a cooling fluid therethrough, and a shroud holds a cooling fluid in contact with the exterior of said seal.

3 Claims, 2 Drawing Figures

HORIZONTAL, DETACHABLE, BALL MILL

BACKGROUND OF THE INVENTION

This invention relates to mills for grinding material, forming dispersions and similar operations of the kind in which the material is located in a container together with a charge of balls, sand particles, or so-called "pearls" and the material and charge are mixed and treated by a rotor in the container. Mills of this kind are used in the manufacture of paint, inks and other compositions.

The object of the invention is to provide an improved mill.

Features of the invention are to provide for continuous running as distinct from batch operations and to provide for comparatively rapid changeover from one kind of material to another, when so desired.

DESCRIPTION OF THE PREFERRED EMBODIMENT

Figure 1:
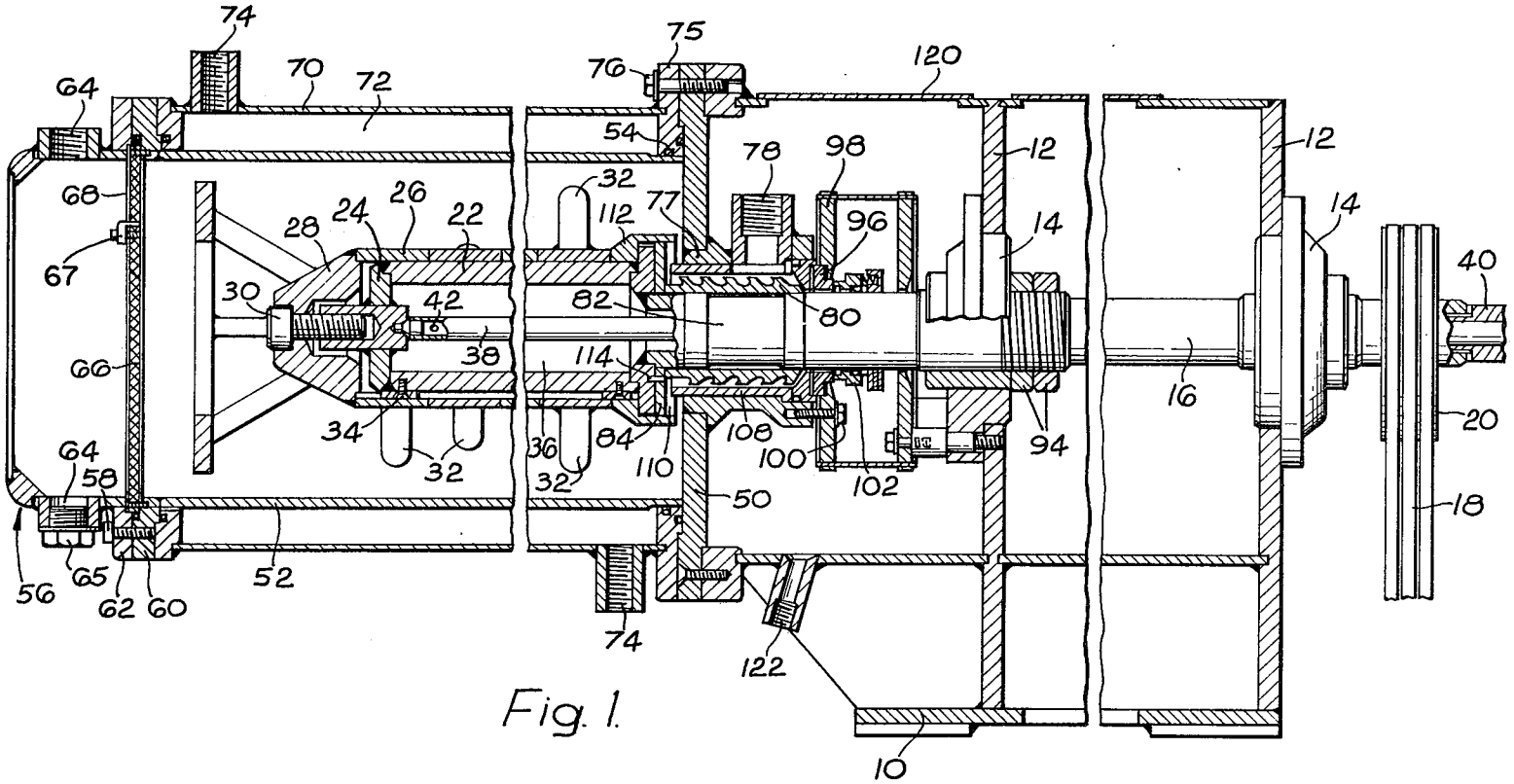
FIG. 1 is a vertical section of a mill.
Figure 2:
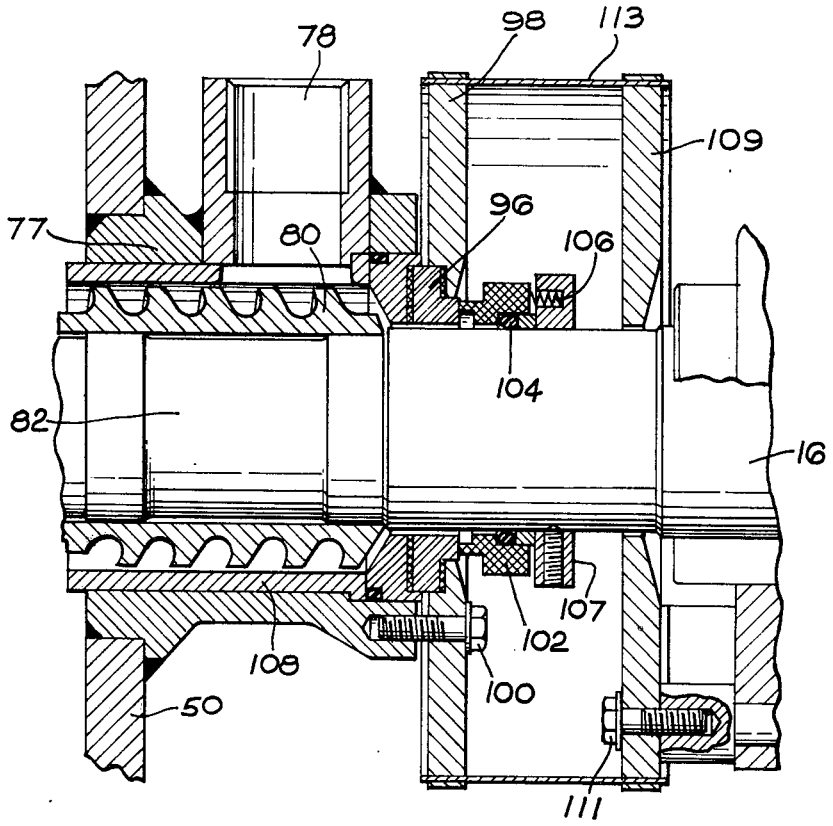
FIG. 2 is an enlarged fragmentary view of part of the same, also in vertical section.

Referring to the drawings, and particularly FIG. 1 thereof, the mill comprises a platform 10 for bolting (for example) to a support surface and mounting a pair of frame elements 12 which via bearings 14 journal a drive shaft 16. The latter is connected to a suitable transmission such as V belts 18 via a pulley 20.

Shaft 16 is fast with a shaft extension 22 which carries a noseblock 24. A rotor hub comprises a sleeve 26 assembled on the shaft extension and integral with a cap 28 which is removably fixed to the noseblock by a single bolt 30, and the sleeve 26 carries radially extending (for example) rotor elements 32, the sleeve and shaft extension being keyed together at 34, so that the rotor system can be changed by removing the bolt 30 and sliding the sleeve 26 off the shaft extension 22.

It will be noted that an annular space 36 is defined within the shaft extension and the shaft by a feed tube 38 extending axially through the shaft interior (the shaft being tubular) and coupled to a rotary union 40 at the drive transmitting end of the shaft, enabling coolant, for example water, to be pumped through the tube, to emerge through ports 42 in the same and return via the annular space (or vice versa).

A container for the mill charge is defined by an end wall 50, fast with the frame elements, an inner liner 52 sealed by an O-ring system 54 to the wall, and an end cap system 56. The end cap is quickly detachable from the liner by, for example, a system of bolts 58 engaged with a first ring 60, and passing through keyhole slots in a second ring 62 which forms part of the cap, so that by turning the cap it may be withdrawn without more than slight slackening of the bolts. The cap has a pair of outlet apertures 64 either or both of which may be connected to a material collection point, although in general only one will be used for such purposes and the other closed by a drain plug 65.

Located between the two rings is a screen which normally serves to retain the charge of "pearls" within the liner; this may conveniently be made in two parts 66, 68 which are secured together by a clamp 67 in order to enable an upper part 68 only to be removed when the "pearls" are being loaded into the mill. The first ring 60 is secured to an outer shell 70 which provides an annular space 72 between it and the liner, and the shell has ports 74 for coolant flow through the said space. The shell with ring 60 is secured to a third ring 75 fixed to wall 50 by bolts 76 enabling rapid dismantling of the complete assembly of liner cap screen and shell if access to the shaft is desired.

It will be noted that the shaft is not journalled or supported in wall 50 and that a housing 77 is secured to the wall and surrounds the shaft. The housing includes a feed port 78 opening to an Archimedean screw feeder provided on a collar 80 which is splined to the shaft portion 82 and extends between a thrust washer 84 and a sealing arrangement as hereinbelow described. The shaft is fixed in position axially by lock nuts 94 on the opposite side of the inner bearing 14.

The housing 77 is provided with a seal comprising a lapped ceramic ring 96 held against an end face of housing 77 by flange 98 clamped by bolts 100, and contacted by carbon thrust ring 102 which is sealed to the shaft by a polytetrafluorethylene "O" ring 104. The rings are urged together by springs 106 carried by a collar 107 which is fixed to the shaft by any convenient means. The ceramic ring remains stationary and the carbon ring rotates with the shaft. A second parallel flange 109 is fixed to the structure by bolts 111, and a sheet metal shroud 113 surrounds the seal. Cooling water is directed through the shroud 113 by means of suitable ports which are not shown, to splash onto the seal. This seal construction is a conveniently available article, and enables efficient sealing to be maintained despite continuous running of the shaft at high speeds.

The throat of the feed passage, that is the space about the Archimedean screw, is provided with a liner tube 108 and material fed through port 78 and via the throat emerges into the container via an annular gap 110 defined by a shroud 112 after turning through 180° in one direction and then at least 90° in the other direction. The thrust washer 84 may be appropriately hardened and is held in position by screws or pegs 114, and the collar 80 may also be hardened.

The frame is or may be completed by a casing 120 with a drain tube 122 for use in the event of spillage or leakage.

It will be appreciated that in continuous running, the liner is loaded with "pearls" or the like which are retained by the screen, whilst material is pump fed via port 78 into the liner to be milled and then travel on axially of the shaft to emerge via the screen and port 64. The action of the screw feeder 80 tends to carry material away from the seal 96, thus reducing the possibility of leakage at this point. When a change of material is required, for example a different colour of paint, the mill may be flushed through with solvent, or if desired the liner and other parts may be removed and interchanged with spares, or cleaned in the dismantled state.

I claim:

1. A mill comprising a shaft mounted in a pair of bearings located at one end of the shaft, and a wall having an opening through which the shaft extends, wherein the improvement comprises a horizontal-flow container for the charge, which is removably mounted at one end in cantilever fashion upon one side of said wall and has a screened outlet at its other end, a tubular inlet housing which is mounted on the other side of said wall, surrounding a portion of the shaft between said wall and said bearings, and which has a seal through which the shaft enters the inlet housing, a feed screw mounted on said portion of the shaft, another portion of the shaft, extending within the container, being of greater diameter than said opening and being closely spaced from said wall to provide a narrow gap through which material passes from the inlet housing into the container, the shaft being hollow and having means for circulating a cooling fluid therethrough, and a shroud for holding a cooling fluid in contact with the exterior of said seal.

2. A mill as claimed in claim 1 wherein the seal between two parts consisting of the inlet housing and the shaft comprises a ceramic ring angularly fast with one part and a carbon ring angularly fast with the other part, the rings being urged into contact.

3. A mill as claimed in claim 1 wherein said container is provided with a detachable cap, and said screen is detachable from the container, the container being detachable from the mill structure.

* * * * *